US005255751A

United States Patent [19]

Stogner

[11] Patent Number: 5,255,751

[45] Date of Patent: Oct. 26, 1993

[54] OILFIELD MAKE-UP AND BREAKOUT TOOL FOR TOP DRIVE DRILLING SYSTEMS

[76] Inventor: Huey Stogner, P.O. Box 803, Houston, Tex. 77001

[21] Appl. No.: 979,131

[22] Filed: Oct. 9, 1992

Related U.S. Application Data

[63] Continuation of Ser. No. 788,806, Nov. 7, 1991, abandoned.

[51] Int. Cl.[5] ..... E21B 19/00

[52] U.S. Cl. ..... 175/203; 175/85

[58] Field of Search ..... 175/57, 85, 203; 166/75, 77, 77.5, 85, 86, 88

[56] References Cited

U.S. PATENT DOCUMENTS

| | | | |
|---|---|---|---|
| 1,417,490 | 5/1922 | Brandon . | |
| 1,884,874 | 10/1932 | Ross . | |
| 1,908,818 | 5/1933 | Brown . | |
| 2,147,002 | 2/1939 | Volpin | 255/35 |
| 2,245,960 | 6/1941 | Claire | 255/23 |
| 2,321,245 | 6/1943 | Reed | 255/35 |
| 3,293,959 | 12/1966 | Kennard | 81/54 |
| 3,629,927 | 12/1971 | Palmer et al. | 29/240 |
| 3,662,842 | 5/1972 | Bromell | 173/1 |
| 3,680,412 | 8/1972 | Mayer et al. | 81/57 |
| 3,719,238 | 3/1973 | Campbell et al. | 175/203 X |
| 4,290,495 | 9/1981 | Elliston | 175/85 |
| 4,403,666 | 9/1983 | Willis | 175/85 |
| 4,570,706 | 2/1986 | Pugnet | 166/77 |
| 4,591,007 | 5/1986 | Shaginian et al. | 175/85 |
| 4,610,315 | 9/1986 | Koga et al. | 175/85 |
| 4,625,796 | 12/1986 | Boyadjieff | 166/77 |
| 4,696,207 | 9/1987 | Boyadjieff | 81/57 |
| 4,738,321 | 4/1988 | Olivier | 175/85 |
| 4,756,538 | 7/1988 | Yuehui et al. | 279/28 |
| 4,765,401 | 8/1988 | Boyadjieff | 166/77 |
| 4,791,997 | 12/1988 | Krasnov | 175/57 |
| 4,843,945 | 7/1989 | Dinsdale | 175/85 X |
| 4,854,400 | 8/1989 | Simpson | 175/85 |

*Primary Examiner*—Thuy M. Bui

*Attorney, Agent, or Firm*—Daniel N. Lundeen; Andrew S. Pryzant

[57] ABSTRACT

An apparatus and method are disclosed for the makeup and breakout of oil well drill pipe for a top drive drilling system. By using drill stock in units of 2 or 3 joints, top drive systems can significantly reduce the drill time. The apparatus comprises a lower housing placed over a rig mouse hole and an upper housing disposed on the lower housing. The housings have jaws to hold individual drill pipe joints and spring biased legs to permit play in the positioning of the lower housing with respect to the rig platform and the positioning of the upper housing with respect to the pipe. A rotatable jaw rotates one of the pipe sections to connect the pipe. The unit drill stock can then be released from the apparatus jaws and inserted into the drill string. Also disclosed is a tool joint box pipe clamp for hoisting of a drill pipe in the practice of the invention.

10 Claims, 3 Drawing Sheets

OILFIELD MAKE-UP AND BREAKOUT TOOL FOR TOP DRIVE DRILLING SYSTEMS

This is a continuation of copending application Ser. No. 07/788,806 filed on Nov. 7, 1991 now abandoned.

FIELD OF THE INVENTION

The present invention relates to oilfield drill pipe make-up and breakout tools for use with top drive drilling systems, particularly to a tool joint box clamp, and a method of drilling using the same.

BACKGROUND OF THE INVENTION

Oil well drilling procedures are well known in the art. Typically, a rotating string of drill pipe having a drill bit bores into the earth. As the bit bores deeper, additional sections of pipe are added to the string. Up until recent years, the string was typically turned by a rotary table fixed on the drilling platform. Corresponding to the requirements of the rotary table, certain standards and well known procedures for drilling were developed. With a rotary table, a long transition joint known as a kelly joint translates force from the table to the string. The string is drilled "kelly down," i.e. the length of the kelly joint, after which the kelly is withdrawn from the bore and an additional unit of drill pipe is inserted between the kelly and the string. The kelly joint, normally 42 feet long, is at least the same length as the drill pipe, typically 30 feet long.

Recent technology has introduced a vertically moveable rotary mechanism which attaches directly to the string, thereby eliminating the long kelly joint. Use of the "top drive" as it is sometimes called obviates the need for withdrawing the kelly joint each time an additional unit must be added to the string. In addition, drill pipe can frequently be added to the string in units of two or more joints, i.e. 60 or 90 feet, with a corresponding reduction in man-hours expended.

To take advantage of the potential savings of top drive systems, it is now necessary to make up double and "thribble" units of pipe while drilling. However, commercial rigs are not typically equipped to do this, and the pipe sections are made up manually using hoists and chain tongs. Frequently, the job of making up double and thribble sections of pipe cannot be done fast enough to keep up with drilling and the time savings from use of the top drive are not fully realized.

A key problem typically encountered when making up doubles and thribbles for top drive drilling is to insure proper alignment of the tool joint ends. Because derrick hoists cannot generally be positioned laterally, a reserve pipe held in a mouse hole must be angled for positioning to a joint suspended by a hoist not directly overhead. Thus, the make-up procedure cannot take advantage of gravity to obtain proper alignment. Heavy cumbersome drill pipe is difficult to handle manually. Mis-alignment can slow the job and gall the threads. Additional problems include applying a proper amount of torque using chain tongs. Usually, overall torque is measured only when the thribble is attached to the top drive unit, and there is no measurement of torque at each joint.

U.S. Pat. No. 3,293,959 to Kennard discloses a pipe-supporting well tool. The device is mounted over the rat hole on a drilling platform. A housing includes a means for supporting a length of pipe to be added to the drill string and clamping means for securing the pipe from rotation during make up with the kelly joint. The housing is mounted on spring legs such that the pipe to be made up will be resiliently supported and upwardly biased to the kelly joint. A winch having a cable and stabbing hook swings over the kelly joint and vertically aligns it with the pipe joint supported by the housing.

Other U.S. patents of interest include U.S. Pat. Nos. 3,144,085; 3,212,578; 4,290,495 to Elliston; U.S. Pat. No. 3,662,842 to Bromell; U.S. Pat. No. 1,417,490 to Brandon; U.S. Pat. No. 1,908,818 to Brown; U.S. Pat. No. 2,142,002 to Volpin; U.S. Pat. No. 2,245,960 to Claire; U.S. Pat. No. 2,321,245 to Reed; U.S. Pat. No. 4,403,666 to Willis; and U.S. Pat. No. 4,591,007 to Shaginian et al.

SUMMARY OF THE INVENTION

A drill pipe make-up and breakout tool of the present invention comprises upper and lower housings having a jaw and spring-biased legs for holding, aligning and rotating drill pipe. The present invention permits double and thribble length pipe joints to be rapidly made up while drilling, provides proper alignment and avoids galling of the threads in the drill pipe, and can tighten the connection to proper torque requirements.

In one embodiment, the present invention provides a method for making up a drill pipe section for drilling a subterranean well bore with a top drive drilling rig, comprising the steps of: (a) positioning a lower housing on spring-biased legs over a hole in a drilling platform; (b) positioning an upper housing on spring-biased legs over the lower housing; (c) releasably attaching a lower end of a cable to a box end of a first drill pipe joint; (d) suspending the first drill pipe joint from the cable and inserting the first drill pipe through the lower housing; (e) receiving the box end of the first drill pipe joint with jaws in the lower housing; (f) releasing the lower end of the cable from the first drill pipe joint and attaching the lower end of the same or a different cable to a box end of a second drill pipe joint; (g) suspending the second drill pipe joint from the cable and inserting a pin end of the second drill pipe joint into the upper housing in engagement with the box end of the first drill pipe joint; (h) securing the pin end in jaws in the upper housing; (i) rotating the jaws in the upper and lower housings with respect to each other to thread the pin end of the second drill pipe joint into the box end of the first drill pipe joint, preferably to a predetermined torque, wherein longitudinal movement between the jaws in the upper and lower housings is taken up by the springs between the upper and lower housings to form a section of joined pipe; (j) releasing the jaws in the upper and lower housings and removing the joined pipe section therefrom; and (k) attaching the joined pipe section to a drill string in the well bore.

In another embodiment, the present invention provides an apparatus for the make-up and breakout of drill pipe for use with a top drive operation. The apparatus comprises a lower housing and an upper housing disposed above the lower housing, each housing having a set of jaws for gripping pipe; spring-biased legs attached to the lower housing for supporting the lower housing over a platform with a hole formed in the platform aligned with the jaws in the lower housing to receive a first pipe depending from the lower housing; spring-biased legs disposed between the upper and lower housing for supporting the upper housing over the lower housing with each set of jaws in alignment; means for releasably positioning a lower end of a second pipe in the jaws of the upper housing in engagement with an upper end of the first pipe held in the jaws of the lower housing; and means for rotating the jaws to threadably connect the first and second pipes wherein travel is taken up by compression of the springs between the upper and lower housings. As a further embodiment, the present invention provides a drill pipe tool joint box clamping apparatus. The clamp comprises a body receivable inside a threaded box end of the drill pipe. The body has a proximal end, a distal end, an interior region and a side wall. The side wall has a plurality of slots therein. The clamp includes a mandrel comprising a mid conical section received in the interior region. A plurality of wedges having an outer threaded radius are slideably affixed to the conical section of the mandrel through the slots in the side wall to form a nipple wherein the threads of the nipple complement the box threads. A cam is rotatably affixed to the mandrel for longitudinally sliding the mandrel with respect to the body and the clamp includes a spring for biasing the cam. The body can be annular with a flange on the proximal end wherein the flange has a lip which engages the side wall for aligning the body in the box end. The mandrel can have upper and lower cylindrical ends and the lower cylindrical end can have a neck formed therein. The wedges can be arcuately shaped and are radially spaced opposite the slots in the side wall. The spring can be disposed in the neck of the lower cylindrical end and the cam affixed to the upper cylindrical end of the mandrel.

DETAILED DESCRIPTION OF THE INVENTION

A drill pipe make-up and breakout tool of the present invention is useful for rapidly making up double and thribble joints of drill pipe suitable for top drive drilling operations. By providing pipe supporting and rotating jaws in housings having spring-biased support legs, the pipe ends can be aligned with minimal difficulty. In addition, a torque gauge can be used to insure a proper amount of torque is applied by the rotating jaw.

Figure 1:
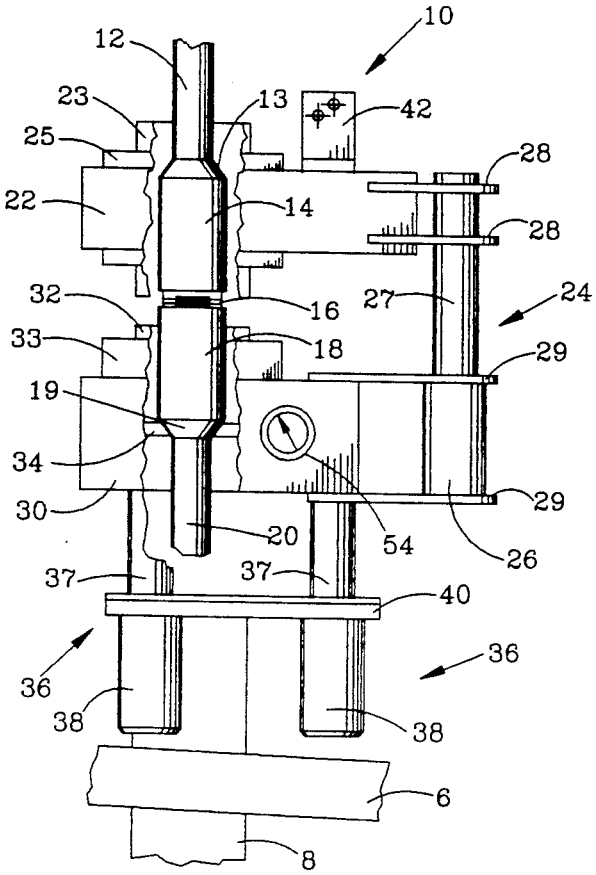
FIG. 1 shows a partially cut-away elevational view of the make-up and breakout tool of the present invention standing angled over the mouse hole wherein the pipe connection is shown.
Figure 2:
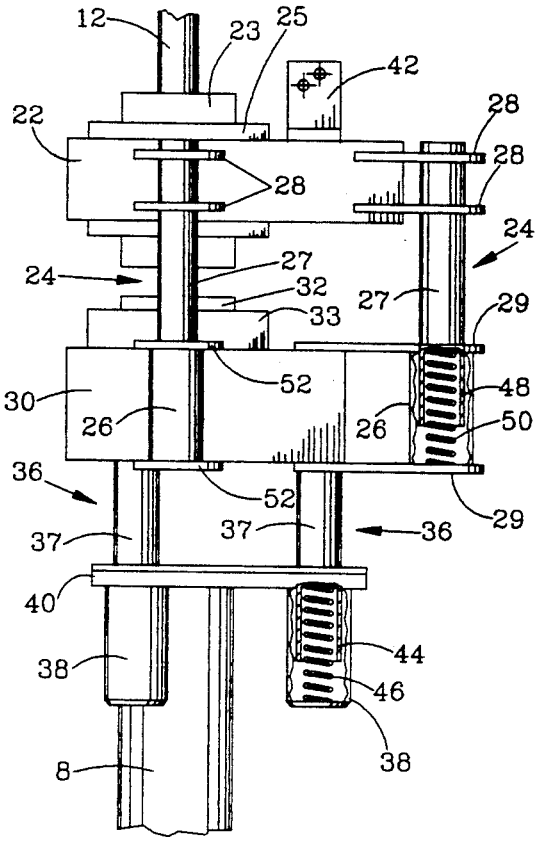
FIG. 2 shows a partially cut-away elevational view of the make-up and breakout tool of the present invention standing upright over the mouse hole wherein springs in the housing legs are shown.
Figure 3:
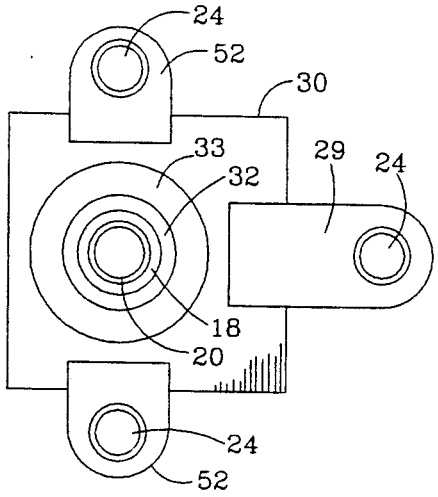
FIG. 3 is a bottom view of the of the make-up and breakout tool of FIG. 1.
Figure 4:
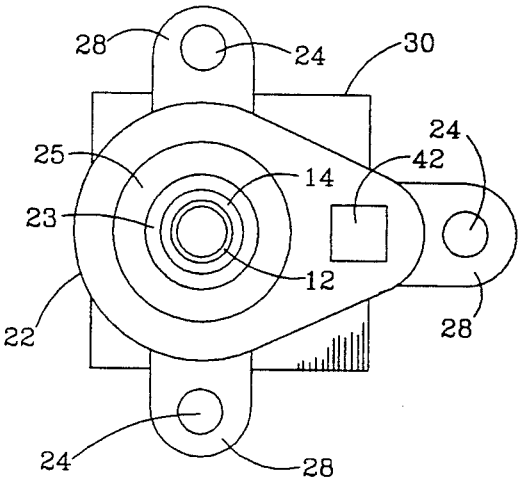
FIG. 4 is a top view of the make-up and breakout tool of FIG. 2.

Referring to FIGS. 1–4, in which like parts are indicated by like reference numerals, a drill pipe make-up and breakout tool 10 comprises an upper housing 22 supported on a lower housing 30 by a plurality of spring biased legs 24 and a lower housing 30 having a plurality of spring-biased legs 36.

The upper housing preferably comprises a reversible rotatable jaw 23 in an enclosure 25 suitable for rotating a pipe 12 having a coupling end 14 with threads 16 known in the art as a "pin." A hydraulic motor 42, for example, provides motive force to the jaw 23.

The lower housing 30 preferably comprises a fixed jaw 32 in an enclosure 33 suitable for holding immobile a pipe 20 under a radial force, wherein the jaw 32 releasably grips the pipe. In an alternative embodiment, the jaw 32 can be rotatable. The lower housing 30 includes a releasable back-up plate 34 having an aperture suitable for retaining the pipe 20 suspended therefrom at a neck 19 formed in the pipe 20 in an absence of gripping force from the jaw 32. The neck 19 is formed by increasing a diameter of the coupling end 18 of the pipe 20 known in the art as a tool joint "box." Design and operation of such pipe gripping jaws 23, 32 as well as back-up plate 34 are well known in the art. Further details regarding the jaws 23, 32 and the back-up plate may be found in Kennard which is hereby incorporated herein by reference.

The tubular upper housing legs 24 comprise an upper leg section 27 having a distal enclosure portion 48 for a spring 50, wherein the distal portion 48 is in telescoping engagement with a lower leg section 26. Compression of the spring 50 preferably allows the upper leg section 27 to travel a suitable distance in the lower leg section 26. The upper leg section 27 is preferably secured to upper housing by support plates 28. The lower leg section 26 is preferably secured to the lower housing 30 by either support plates 29 or 52 depending on a spatial arrangement of the legs 24 on the upper housing 22.

The tubular lower housing legs 36 comprise an upper leg section 37 having a distal enclosure portion 44 for a spring 46, wherein the distal portion 46 is in telescoping engagement with a lower leg section 38. Compression of the spring 44 preferably allows the upper leg section 37 to travel a suitable distance in the lower leg section 38. The upper leg section 37 is secured to the lower housing 30. The lower leg section 38 is preferably secured to the upper leg section 37 by means of a support plate 40.

In a preferred embodiment, the lower housing 30 has a torque gauge 54 for ascertaining the torque applied by the rotatable jaw 23 on the pipe 12. A commercially available torque gauge for this purpose is disclosed in aforementioned U.S. Pat. No. 3,293,959 to Kennard.

The tool 10 threadably joins one section of drill pipe to another. In operation, lower housing 30 of the tool 10 is positioned on the spring-biased legs 36 over a mouse hole s or other aperture of suitable depth in a platform 6. The bottom drill pipe 20 is lowered box side up through the upper and lower jaws 23, 32 by a hoist (not shown) to position the neck 19 of the box 18 adjacent the back-up plate 34. The length of the pipe is received by the mouse hole 8. The back-up plate 34 is then closed under the neck 19 retaining the pipe 20. The lower jaw 32 is clamped on the box 18 of pipe 20 to inhibit rotation thereof. The top pipe 12 is similarly hoisted and lowered into the upper jaw 23 of the upper housing 22, wherein the pin 14 is clamped by the jaw 23. To facilitate proper alignment of the complementary threads 16 of the pin 14 with the threads of the box 18, spring-biased legs 24, 30 allow for lateral and longitudinal play in the upper and lower housings 22, 30. Activation of the jaw rotating motor 42 in a proper direction of rotation (generally clockwise) joins the pipes 12, 20 by threading the pin 14 into the box 18.

To release the joined pipe, the upper and lower jaws 23, 32 are unclamped and the back-up plate 34 is opened. The double, for example, may be hoisted for use in the drill string. An additional joint may be added to make a thribble. The double can be lowered further into a mouse hole having sufficient depth so that the box end of the top joint is held at the backup plate 34 in the lower housing and another single can be joined to the double as previously described above. Alternatively, especially where the mouse hole is not deep enough to receive the double, the double can be hoisted and set aside while a single is lowered into the tool 10 so that the box end is held at the back-up plate 34. The double is then joined to the single as described above. The thribble once made is stood in the derrick for immediate use or back in the fingerboard until needed. The upper end of the thribble is typically attached to a top drive assembly sufficiently high in the derrick, e.g. at least 90 feet, so that the lower end of the thribble can be attached to the drill string, typically held in slips in the floor of the drilling platform.

In a preferred embodiment, the pipe 20 as mentioned previously is held immobile by the lower jaw 32. Consequently, the top pipe 12 is drawn toward the bottom pipe 20 as the pin 14 is threaded into the box 18. Longitudinal travel between the upper housing 22 with respect to the lower housing 30, typically about 5 inches, is taken up by compression of the springs 48 in the legs 24 of the upper housing 30.

The breakout procedure of a double or thribble length of pipe reverses the make-up procedure described above. The thribble, for example, is lowered into the jaws 23, 32 of the present invention positioned over the mouse hole s until the box portion neck 19 of the bottom or middle joint (depending on the mouse hole depth) is adjacent the back-up plate 34 which is closed. The jaws are clamped to the pipe and the top joint is broken out by operating the rotating jaw 23 in a direction (usually counterclockwise) suitable for unthreading the top joint. The upper jaw 23 is unclamped and the released joint is hoisted away. The remaining double length is then positioned so that the bottom joint box is held by the back-up plate 34, and the top joint is unthreaded.

Figure 5:
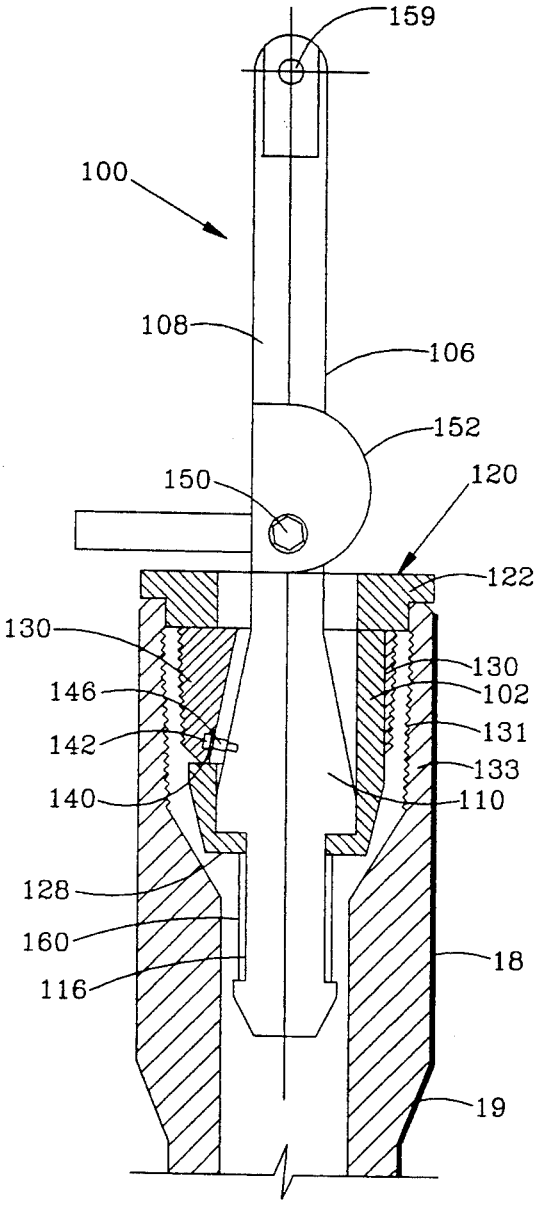
FIG. 5 is a cross-sectional view of a tool joint box clamping device suitable for use with a make-up and breakout tool of the present invention in an unlocked position.
Figure 6:
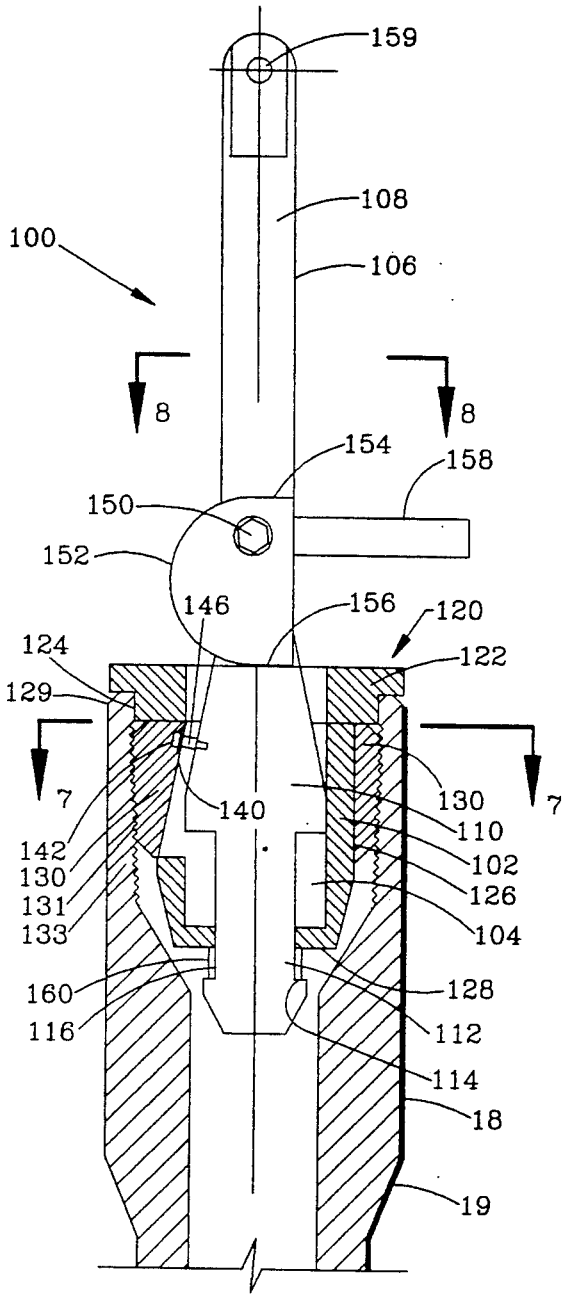
FIG. 6 is a cross-sectional view of a tool joint box clamping device suitable for use with the make-up and breakout tool of the present invention, shown in a locked position.
Figure 7:
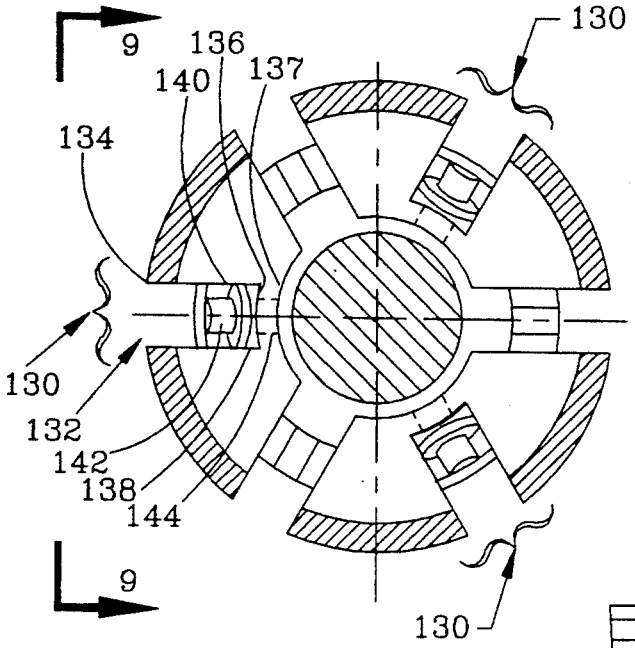
FIG. 7 is a top view of a tool joint box clamping device seen along the lines 7—7 in FIG. 6.
Figure 9:
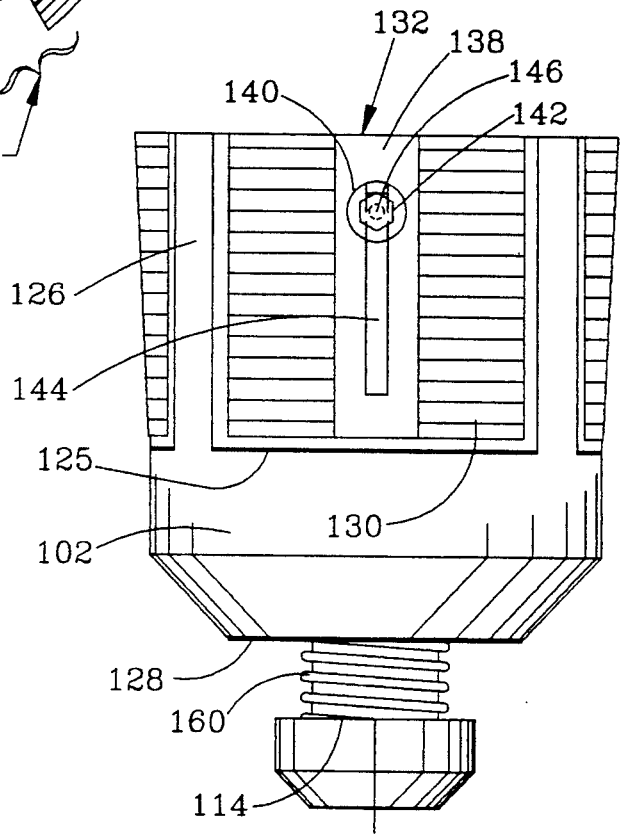
FIG. 9 is a frontal view of a wedge section of FIG. 7 of a tool joint box clamping device.
Figure 8:
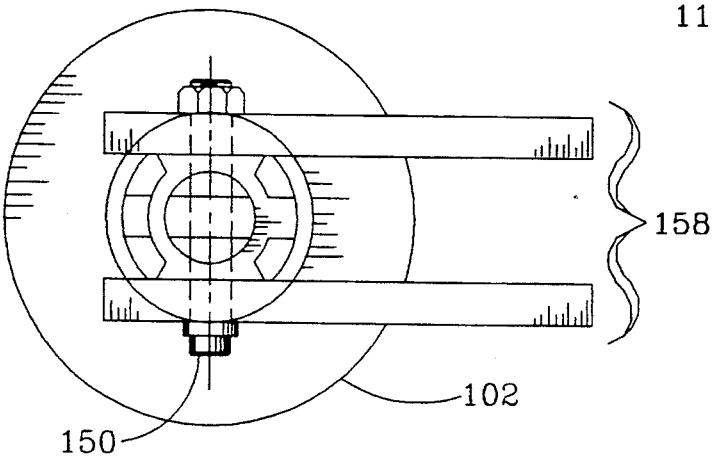
FIG. 8 is a top view of a tool joint box clamping device seen along the lines 8—8 in FIG. 6.

In the practice of the present invention, referring to FIGS. 1 and 5–9, the joint of drill pipe 12 is preferably hoisted by derrick hoist (not shown) using a tool joint box clamp 100. The clamp 100 is designed to form a releasable quick-connect nipple which interlocks with threads of the tool joint box 18. Using the clamp 100 to hoist the pipe, the neck 19 of the box 18 remains unencumbered. It is readily appreciated that if the joint is hoisted by an apparatus secured around the neck 19 of the pipe 20, such as a chain or tong collar, then the hoisting apparatus can interfere with the use of the tool 10 and placement of the made up double or thribble in the fingerboard. However, to insert the double or thribble into the drill string, the box clamp 100 is removed and conventional hoisting techniques are used.

The box clamp 100 has a body 102 with an annular region 104 received in a tool box joint of a drill pipe. The annular body 102 has a proximal end 120 which can have a flange 122, a plurality of which can be radially spaced slots 125 in a side wall 126 and a distal end 128. When the body 102 of the clamp 100 is inserted into the box 18, a lip 124 of the flange 122 can engage an upper edge 129 of the box 18 so that proper positioning of the body 102 within the box 18 is attained.

A mandrel 106 comprising an upper section 108 which can be cylindrical, a section 110 which can be conical and a lower section 112 which can be cylindrical is associated with the annular body 102 wherein the conical section 110 is slideably received in the annular region 104.

A ring formed from a plurality of separate arcuate wedge sections 130 which can comprise three radially-spaced sections form a sleeve surrounding the conical section 110 of the mandrel 106, wherein each wedge 130 is aligned opposite the slot 125 in the body 102. A longitudinal channel 132 cut from an outer radius 134 of the wedge 130 to a suitable mid-radius point 136 approximately bisects each wedge 130. The channel 132 has a bottom surface 138 of appropriate width for slideably engaging a washer 140 and a bolt 142. In the channel 132, a longitudinal slit 144 of suitable length and width is cut from the mid-radius point 136 through an inside radius 137 of each wedge 130 for passage of a bolt body 146. The wedge sections 130 are affixed to the conical section 110 of the mandrel 106 by the bolts 142 so that a bolt head engaging the washer 140 slides along the surface 138 at the base of the channel 132. The wedges 130 in conjunction with the conical section 110 form a "nipple" having a threaded outer diameter taper 131 complementary to the threaded inner diameter taper 133 of the box.

The outer diameter 131 of the nipple is variable depending upon the longitudinal position of the conical section 110 in the body 102. To engage the clamp 100, upward sliding of the mandrel conical section 110 provides a radial force against the wedges 130. The bolts 142 slide upward along the channel 132 radially expanding the wedge sections 130 to increase the overall diameter 131 of the nipple. The complementary threads of the nipple diameter 131 and the box diameter 133 intermesh to lock the clamp 100 into position. To release the clamp 100, downward sliding of the mandrel conical section 110 releases the radial force on the wedges 130. The bolts 142 slide downward along the channel 132 radially contracting the wedge sections 130 to decrease the overall diameter 131 of the nipple. On release of the clamp 100, the wedges 130 preferably withdraw from the threads of the box a sufficient distance to prevent snagging on the box threads.

Longitudinal positioning of the mandrel 106 with respect to the body 102 is preferably effected by rotation of an eccentric, arcuate cam pivotally attached on a pivot 150 to the upper section 108 of the mandrel 106, wherein a first flat cam surface 154 abuts a shoulder (not shown) defined by a cutout (not shown) in the upper mandrel 108 and a second flat cam surface 156 abuts the flange end 120 of the body 102. In a preferred embodiment, dual, opposing mandrel pivoting cams are utilized for an even distribution of force on the wedges 130. The cam 152 is preferably manually rotated by a dual handle 158 securely affixed thereto. The upper mandrel 108 also has an aperture 159 for attaching the clamping tool 100 to a swivel of a winch or hoist by a hook or cable.

Longitudinal movement of the mandrel 106 with respect to the body 102 can be biased by a spring 160 adjacent the annular body 102 a neck 116 formed in the lower mandrel end 112 between a shoulder 114 and the distal end 128 of the body 102. Upward movement of the mandrel 106 with respect to the body 102 to engage the clamp 100 compresses the spring 160 between the shoulder 114 and the distal body end 128. Compressive spring energy assists the release of the clamp 100 from the box 18 by reversing the movement of the mandrel 106.

When it is desired to use the clamp 100 to hoist a drill pipe, the hoist having the tool 100 attached by a chain or cable, for example, is positioned to allow a drill crew member to insert the body 100 of the tool 100 into the tool joint box. The handles 158 of the cams 150 which work in concert are rotated to force the nipple formed by the wedges 130 into the threads of the box. When it is desired to release the clamp 100, the position of the cam rotating handles 158 is reversed to release and Withdraw the wedges 130 from the box threads.

The preferred tool joint box clamp 100 has a number of benefits and advantages, particularly when used to hoist, maneuver and position pipe in the make-up and breakout method described above. The clamp 100 can be readily inserted into the box, and it is not necessary to be able to gain access to the periphery of the pipe to attach a chain or cable under the neck as in conventional hoisting. Similarly, there is no chain or cable around the pipe to interfere with placement of the pipe in the derrick, e.g. in a fingerboard, or in a horizontal stack where it would be difficult to secure or remove the cable or chain from around the outside of the pipe. Also, the tool box clamp 100 can be quickly and easily connected to the box of the pipe, and the personnel hazard posed by the circumferential placement of cable or chains is largely eliminated.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

What is claimed is:

1. A drill pipe tool joint box clamping apparatus, comprising:

an annular body receivable inside a threaded box end of the drill pipe, said body having a proximal flange end, a distal end and a side wall, said wall having a plurality of radially spaced slots therein, said flange end having a lip for engaging said side wall;

a mandrel comprising an upper cylindrical end, a mid conical section and a lower cylindrical end having a neck, wherein said conical section is received in said body;

a plurality of radially spaced arcuate wedges having an outer threaded radius, wherein said wedges are slideably affixed to said conical section of said mandrel in said slots in said side wall to form a nipple, wherein threads of said nipple complement said box threads;

a spring disposed on said neck of said lower mandrel end exterior to said body;

a cam rotatably fixed to said upper cylindrical end biased by said spring for longitudinally sliding said mandrel with respect to said body.

2. A drill pipe tool joint box clamping apparatus, comprising:

a body receivable inside a threaded box end of the drill pipe, said body having a proximal end, a distal end, an interior region and a side wall, said wall having a plurality of slots therein;

a mandrel comprising a mid conical section received in said interior region;

a plurality of wedges having an outer threaded radius, wherein said wedges are slideably affixed to said conical section of said mandrel in said slots in said side wall to form a nipple, wherein threads of said nipple complement said box threads;

a cam rotatably affixed to said mandrel for longitudinally sliding said mandrel with respect to said body; and a spring for biasing said cam.

3. The clamp of claim 2, wherein said body is annular and said proximal end has a flange, wherein a lip on said flange engages said side wall for aligning said body in said box end.

4. The clamp of claim 2, wherein said mandrel includes upper and lower cylindrical ends and said lower ends has a neck.

5. The clamp of claim 2, wherein said wedges are arcuately shaped.

6. The clamp of claim 2, wherein said wedges are radially spaced.

7. The clamp of claim 4, wherein said spring is disposed on said neck of said lower cylindrical end.

8. The clamp of claim 2, wherein said cam is affixed to said upper cylindrical end.

9. A method for clamping a drill pipe joint comprising the steps of:

(a) inserting a clamp inside a threaded box end of the drill pipe, said clamp comprising a body having a proximal end, a distal end, an interior region and a side wall having a plurality of slots therein, a mandrel having a mid conical section received in said interior region, a plurality of threaded nipple forming wedges slideably affixed to said conical section opposite said slots in said side wall, a cam rotatably affixed to said mandrel for longitudinally sliding said mandrel with respect to said body, and a spring for biasing said cam, wherein threads of said wedges complement said box threads; and (b) outwardly sliding said wedge threads into said box threads by pivoting said cam to lock said clamp therein.

10. The method of claim 9, further comprising the step of aligning said wedge threads with said box threads prior to said wedge sliding step.

* * * * *